US008695460B2

(12) United States Patent
Liau

(10) Patent No.: US 8,695,460 B2
(45) Date of Patent: Apr. 15, 2014

(54) WRENCH

(76) Inventor: Jia-Guann Liau, Taichung (TW)

( * ) Notice: Subject to any disclaimer, the term of this patent is extended or adjusted under 35 U.S.C. 154(b) by 251 days.

(21) Appl. No.: 13/369,316

(22) Filed: Feb. 9, 2012

(65) Prior Publication Data

US 2013/0205953 A1 Aug. 15, 2013

(51) Int. Cl.
*B25B 13/08* (2006.01)
*B25B 13/00* (2006.01)

(52) U.S. Cl.
CPC ..... *B25B 13/00* (2013.01); *B25B 13/08* (2013.01)
USPC ..... 81/119; 81/124.2

(58) Field of Classification Search
USPC ..... 81/119, 124.2, 124.3, 125.1; D8/21, 27, D8/28
See application file for complete search history.

(56) References Cited

U.S. PATENT DOCUMENTS

| | | | | | |
|---|---|---|---|---|---|
| D177,636 | S | * | 5/1956 | Meier et al. | D8/28 |
| 6,715,383 | B1 | * | 4/2004 | Hsien | 81/119 |
| D519,009 | S | * | 4/2006 | Hsieh | D8/28 |
| D632,147 | S | * | 2/2011 | Yang | D8/28 |
| D650,645 | S | * | 12/2011 | Dosch et al. | D8/21 |
| D672,216 | S | * | 12/2012 | Hsieh | D8/28 |

* cited by examiner

*Primary Examiner* — David B Thomas

(57) ABSTRACT

A wrench includes a handle having a driving head which has a clamping hole. The driving head has a top surface and a bottom surface. The outer periphery of the top surface is tangent to an inside of a first circle and the outer periphery of the bottom surface is located on a second circle. The first circle is larger than the second circle. The second circle is larger than the clamping hole. When the first and second circles are projected on a horizontal plane, the second circle is located within the first circle and is tangent to the second first circle at a tangent point. The clamping hole and the first circle are located on a common axis which is located on a vertical plane. The two respective centers of the first and second circles and the tangent point are located on the vertical plane.

11 Claims, 10 Drawing Sheets

WRENCH

FIELD OF THE INVENTION

The present invention relates to a wrench, and more particularly, to an open wrench wherein the open driving head includes multiple protrusions extending from an inside thereof.

BACKGROUND OF THE INVENTION

A conventional box wrench is shown in FIG. 9 and generally includes a first driving head 40 which is a box end at an end of the handle and multiple protrusions 41 extending from the inside of the box end 40, and a second driving head 42 which is an open end is connected to the other end of the handle. When rotating the bolts of a piping system, the first driving head 40 cannot be used so that the user has to switch the wrench to the second driving head 42, and this is not convenient for the user.

In order to improve the shortcoming of the conventional wrench as shown in FIG. 9, another wrench as shown in FIGS. 11 to 12 is provided and includes an opening 52 defined in a side of the box end driving head 50 which has protrusions 51 extending from the inside thereof so as to be used to the bolts of the piping system. However, the opening 52 reduces the strength of the box end driving head 50 and the maximum torque that the wrench can output is reduced. The two jaws of the driving head 50 may be expanded outward.

In order to improve the shortcoming of the conventional wrench as shown in FIGS. 10 to 12, yet another wrench as shown in FIG. 13 is provided and includes a thickened base at the connection between the C-shaped driving head 60 and the handle 61. As shown in FIG. 14, the outer periphery of the top surface 62 and the bottom surface 620 of the C-shaped driving head 60 are located on an oval 64 which tangents a standard circle at a point "E" so that the length of the wrench does not need to be increased and the symmetric principle is maintained. However, the thickened area has to be located at the connection between the C-shaped driving head 60 and the handle 61, the thickness of the jaws 66 beside the opening 65 cannot be increased. Therefore, the shortcoming of the outward expanding of the jaws is not improved.

SUMMARY OF THE INVENTION

The present invention relates to a wrench includes an elongate handle having a driving head connected to the first end thereof and the driving head has a clamping hole. An opening is defined through the driving head. The driving head has a top surface and a bottom surface. The outer periphery of the top surface is tangent to an inside of a first circle and the second outer periphery of the bottom surface is located on a second circle. The diameter of the first circle is larger than that of the second circle. The diameter of the second circle is larger than that of the clamping hole. When the first and second circles are projected on a horizontal plane, the second circle is located within the first circle and is tangent to the second first circle at a tangent point which is located close to the front end of the driving head. A shortest distance is defined between two respective centers of the first and second circles. The clamping hole and the first circle are located on a common axis which is located on a vertical plane. The two respective centers of the first and second circles and the tangent point are located on the vertical plane. The two jaws are symmetric relative to the vertical plane.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
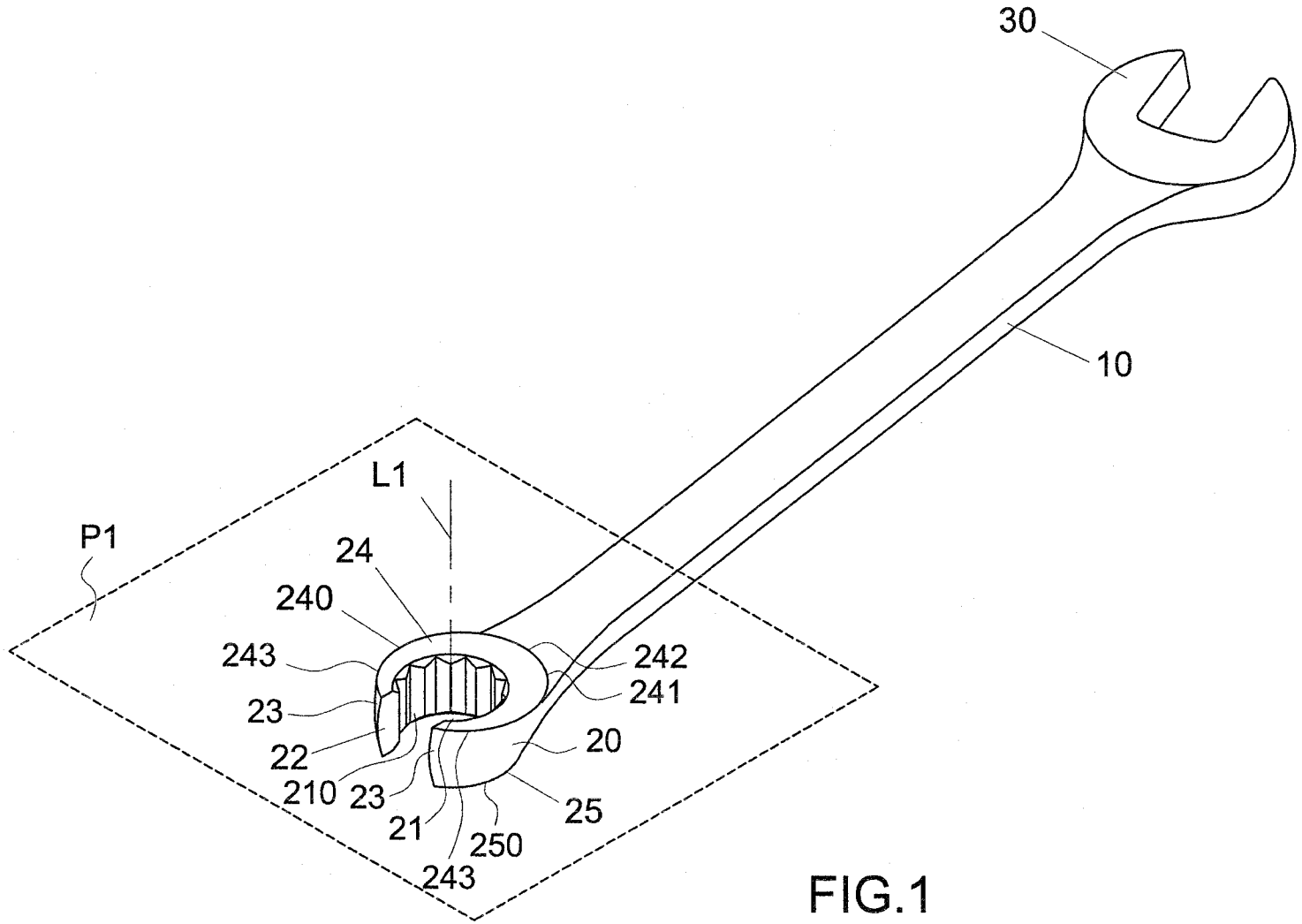
FIG. 1 is a perspective view to show the wrench of the present invention.
Figure 2:
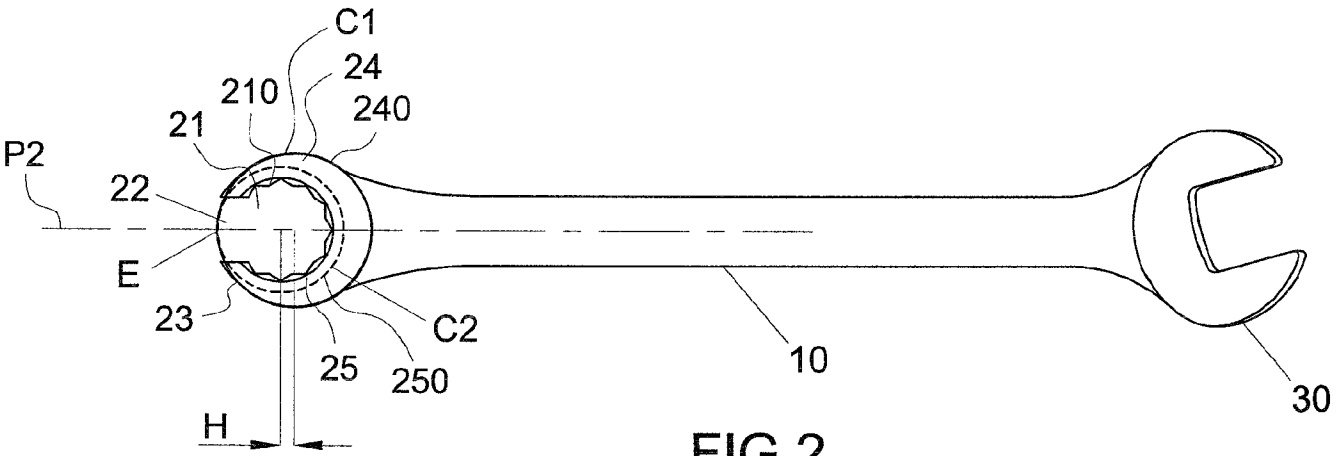
FIG. 2 is a top view of the wrench of the present invention.
Figure 3:
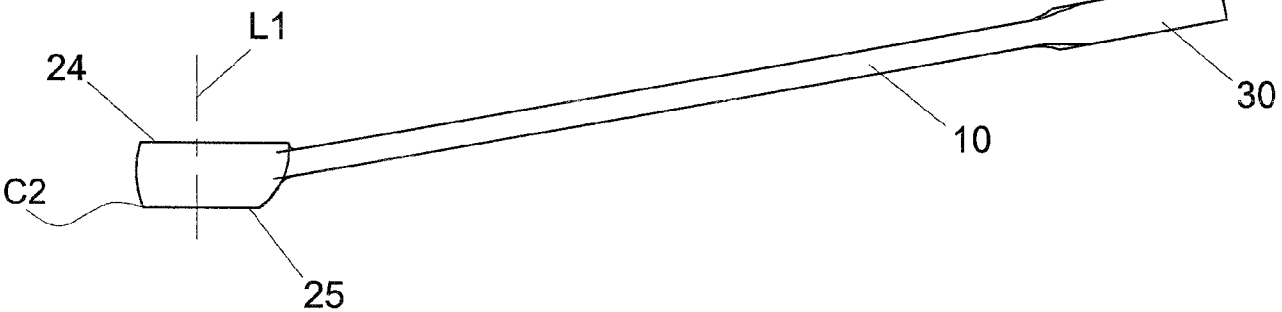
FIG. 3 is a side view of the wrench of the present invention.

Referring to FIGS. 1 to 3, the wrench of the present invention comprises an elongate handle 10 which has a first driving head 20 connected to a first end thereof and a clamping hole 21 is defined through the first driving head 20. An opening 22 is defined through the front end of the first driving head 20 and communicates with the clamping hole 21 so as to form two jaws 23 with the opening 22 located between the two jaws 23 which are symmetric relative to each other. The first driving head 20 has a top surface 24 and a bottom surface 25, the top and bottom surfaces 24, 25 are parallel to a horizontal plane P1. The top and bottom surfaces 24, 25 are C-shaped surfaces and located along the clamping hole 21. Multiple protrusions 210 extend from the inside of the clamping hole 21 and located about an axis of the clamping hole 21. A 30-degree angle or a 60-degree angle is defined between the adjacent protrusions 210. In the drawings, the angle is a 30-degree angle. A first outer periphery 240 of the top surface 24 is tangent to the inside of a first circle C1. In the drawings, there is at least ⅓ of the first outer periphery 240 is located on the first circle C1. A second outer periphery 250 of the bottom surface 25 is located on a second circle C2. The diameter of the first circle C1 is larger than the diameter of the second circle C2, and the diameter of the second circle C2 is larger than the diameter of the clamping hole 21. When the first and second circles C1, C2 are projected on the horizontal plane P1, the second circle C2 is located within the first circle C1 and is tangent to the second first circle C1 at a tangent point E which is located close to the most front end of the first driving head 20. A shortest distance H is defined between two respective centers of the first and second circles C1, C2. The clamping hole 21 and the first circle C1 is located on a common axis L1 which is located on a vertical plane P2. The two respective centers of the first and second circles C1, C2 and the tangent point E are located on the vertical plane. The two jaws 23 are symmetric relative to the vertical plane P2.

As shown in FIG. 1, the first driving head 20 and a second driving head 30 are respectively to the first and second ends of the handle 10. The second driving head 30 includes an opening.

Figure 4:
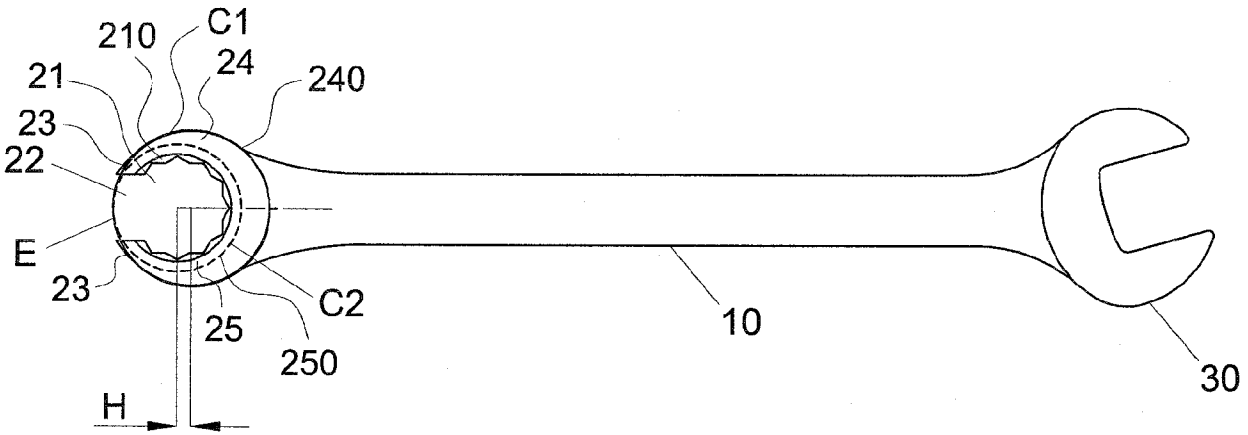
FIG. 4 is a top view of the second embodiment of the wrench of the present invention.
Figure 5:
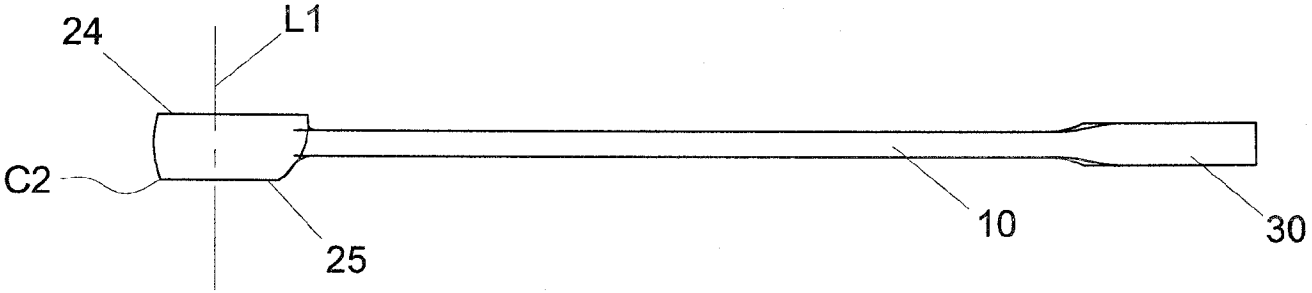
FIG. 5 is a side view of the second embodiment of the wrench of the present invention.

As shown in FIGS. 4 and 5, the handle 10 and the first driving head 20 are flat relative to the horizontal plane P1. As shown, the top surface of the handle 10 is parallel to the top surface 24.

Figure 6:
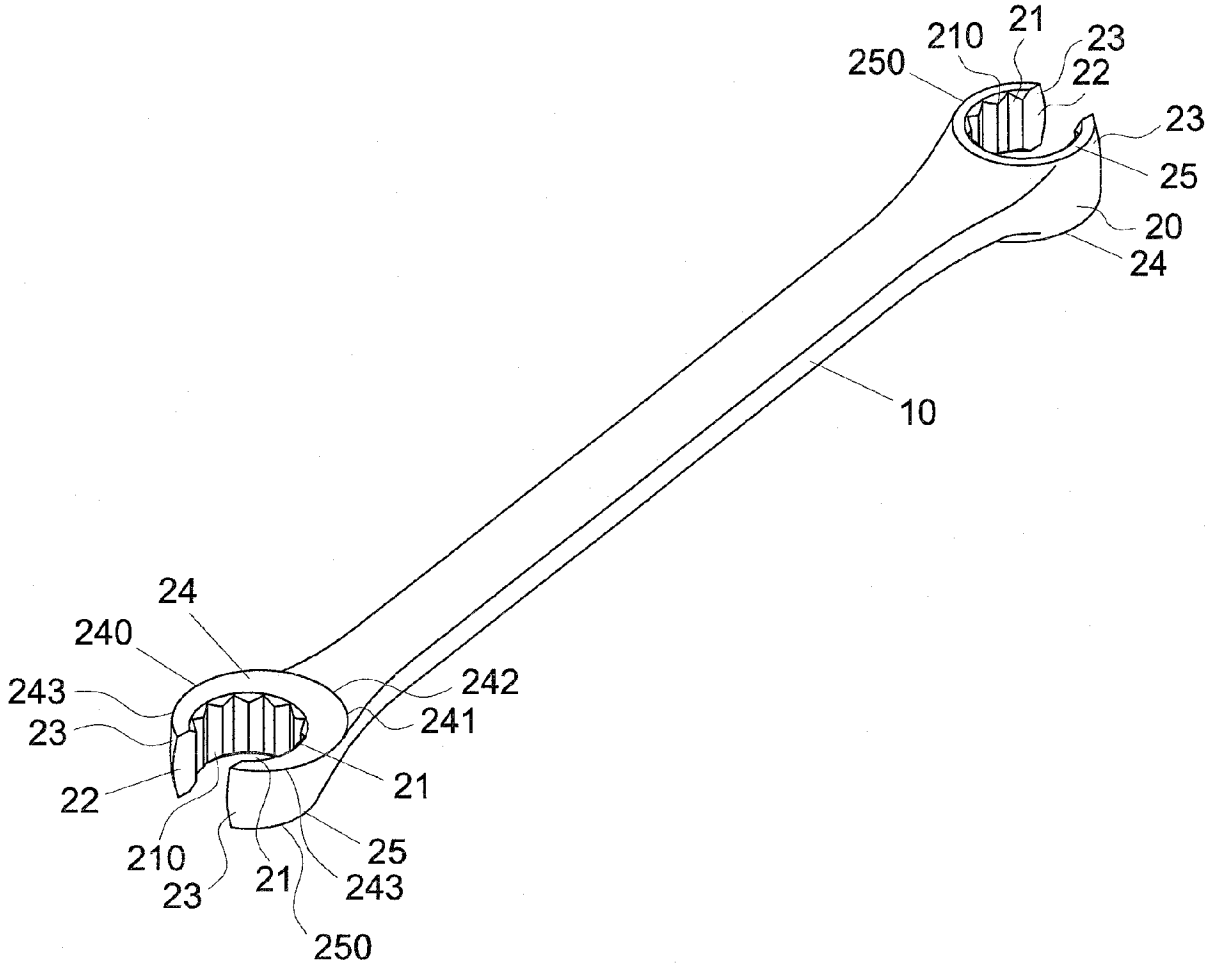
FIG. 6 is a perspective view to show the third embodiment of the wrench of the present invention.

As shown in FIG. 6, two respective first driving heads 20 are connected to two ends of the handle 10 and the two first driving heads 20 face two opposite directions.

Figure 7:
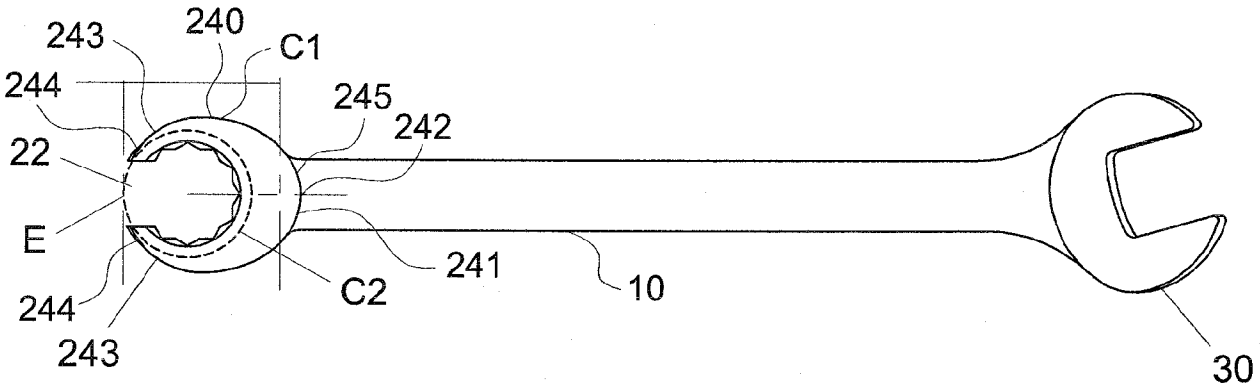
FIG. 7 is a top view of the third embodiment of the wrench of the present invention.
Figure 8:
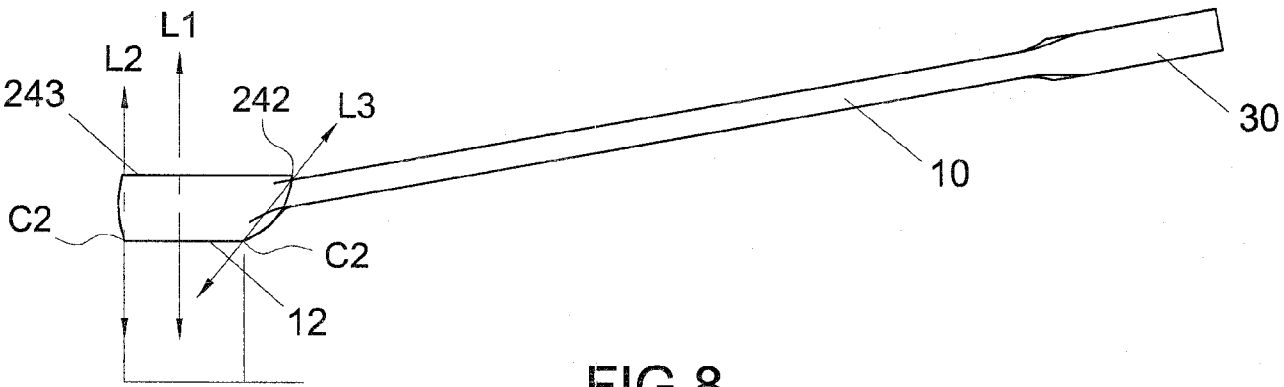
FIG. 8 is a side view of the third embodiment of the wrench of the present invention.
Figure 9:
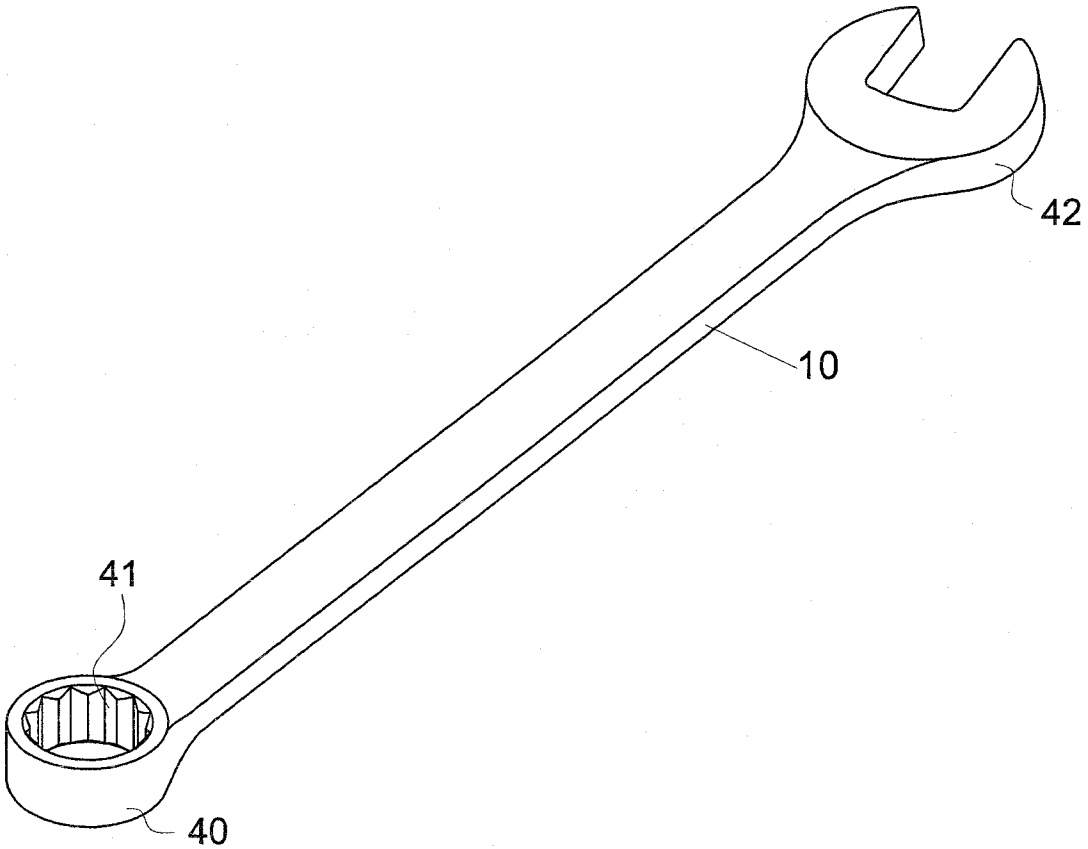
FIG. 9 is a perspective view to show the conventional box end wrench.
Figure 10:
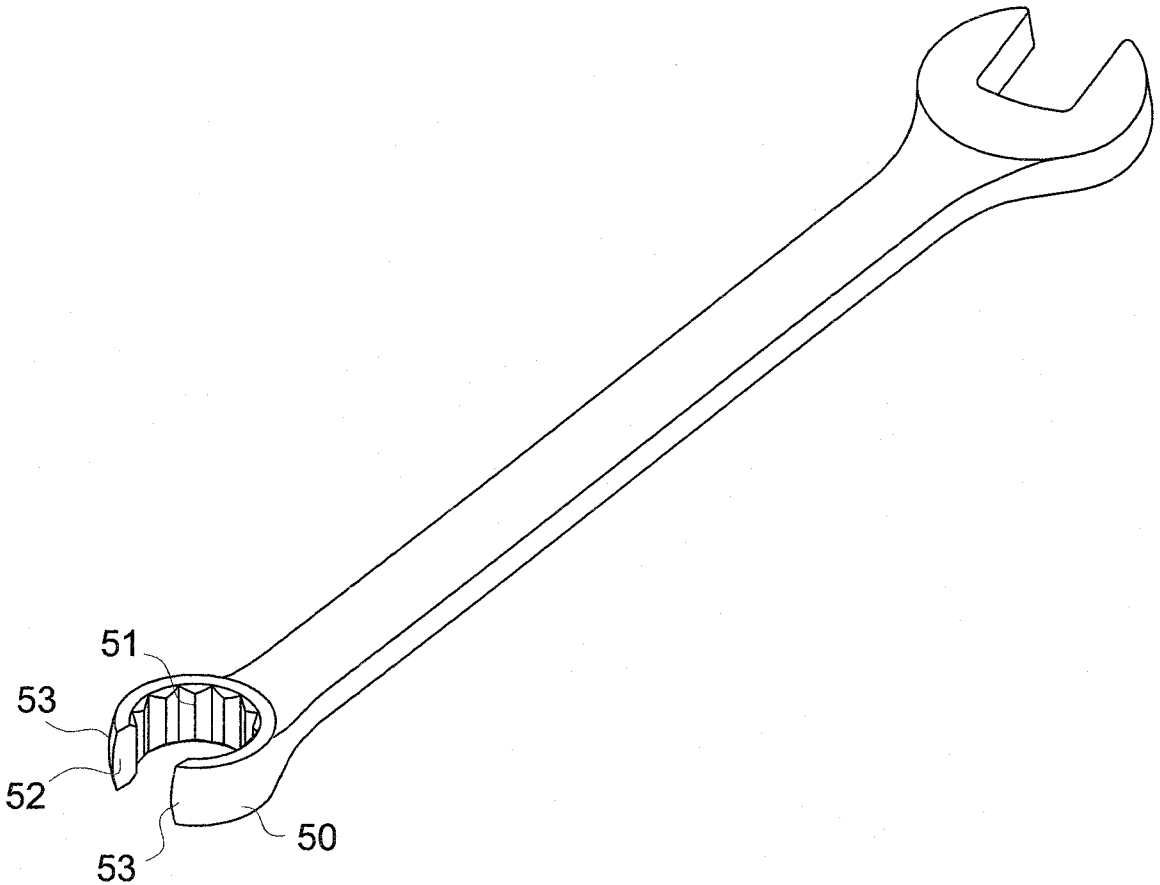
FIG. 10 is a perspective view to show a first conventional wrench.
Figure 11:
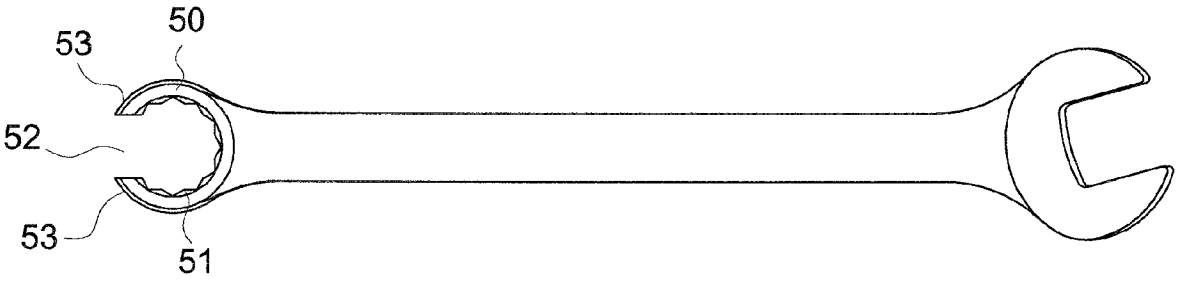
FIG. 11 is a top view of the first conventional wrench.
Figure 12:
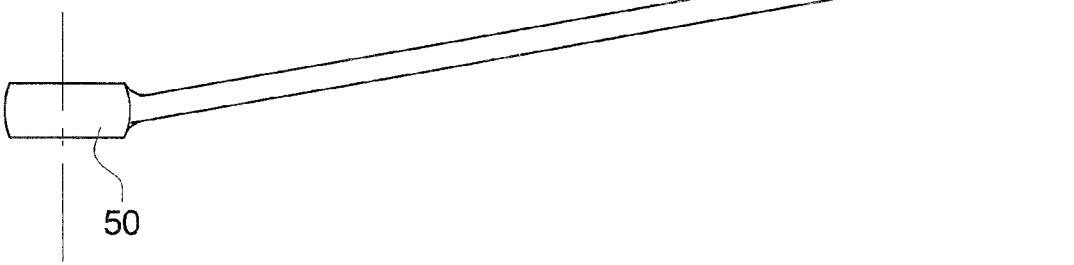
FIG. 12 is a side view of the first conventional wrench.
Figure 13:
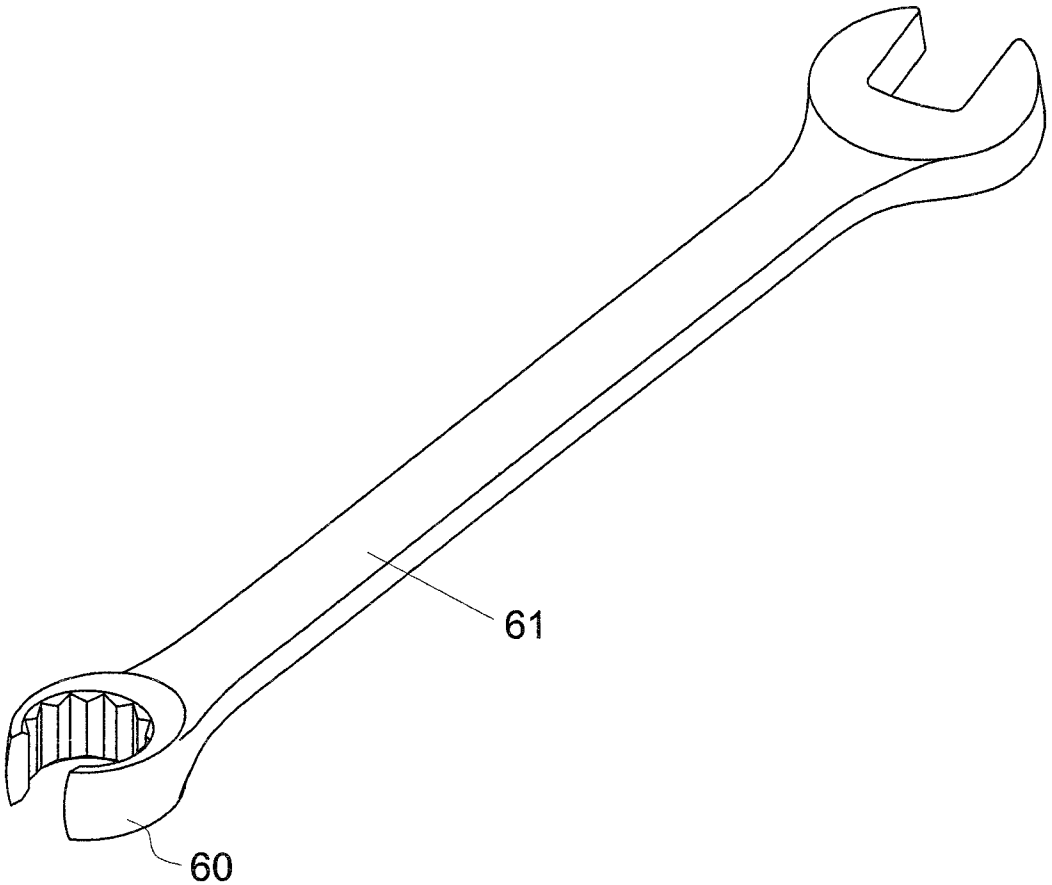
FIG. 13 is a perspective view to show a second conventional wrench.
Figure 14:
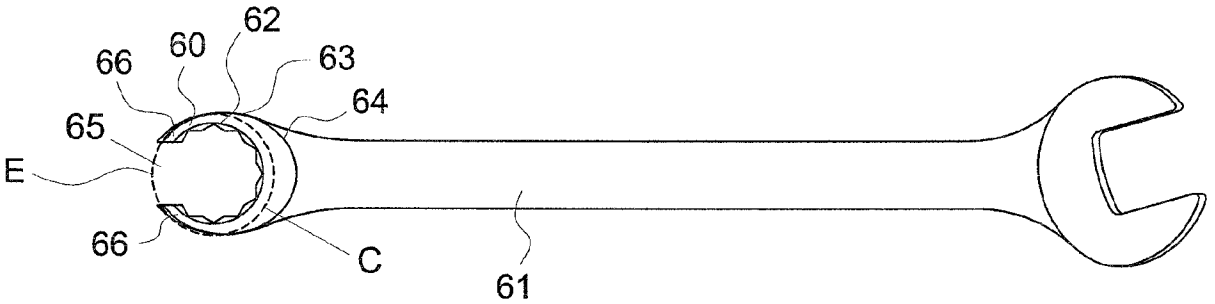
FIG. 14 is a top view of the second conventional wrench.
Figure 15:
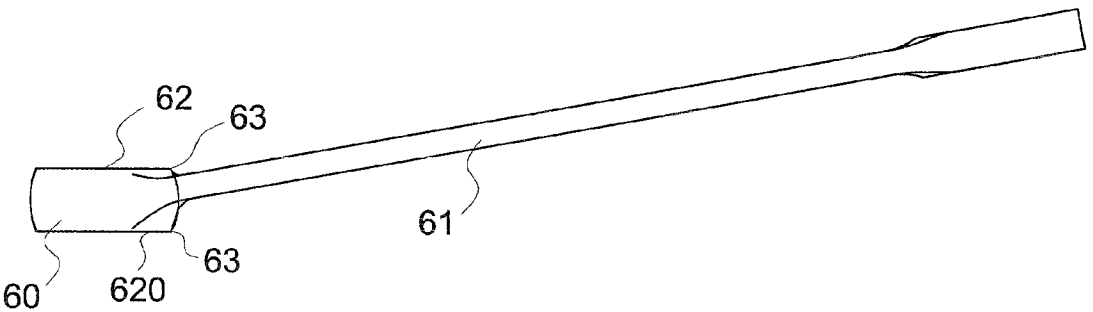
FIG. 15 is a side view of the second conventional wrench.

As shown in FIGS. 7 and 8, a middle point 242 of a middle section 241 of the top surface 24 is located close to the handle 10. Two respective outer peripheries 240 of end sections 243 of the top surface 24 respectively extend along at least one first non-circular curve 244. The first non-circular curve 244 is located farther than the first circle C1 relative to the vertical plane P2 so as to reinforce the strength of the jaws 23. Furthermore, the middle section 241 of the first outer periphery 240 of the top surface 24 extends along the second non-circular curve 245. The distance from the middle point 242 to a center of the first circle C1 is larger than the radius of the first circle C1 so as to reinforce the strength of the connection portion between the first driving head 20 and the handle 10. In the drawings, the first and second non-circular curves 244, 245 are respectively two individual oval curves. The section of the shortest distance between the distal end of the end section 243 and the second circle C2 is located on the first line L2. The section of the shortest distance between the middle point 242 and the second circle C2 is located on the second line L3. The clamping angle between the second line L2 and the common axis L1 is less than 5 degrees, and the clamping angle between the second line L3 and the common axis L1 is larger than 30 degrees.

While we have shown and described the embodiment in accordance with the present invention, it should be clear to those skilled in the art that further embodiments may be made without departing from the scope of the present invention.

What is claimed is:

1. A wrench comprising:

an elongate handle having a first driving head connected to a first end thereof and a clamping hole defined through the first driving head, an opening defined through the first driving head and communicating with the clamping hole so as to form two jaws with the opening located between the two jaws which are symmetric relative to each other, the first driving head having a top surface and a bottom surface, the top and bottom surfaces being parallel to a horizontal plane, the top and bottom surfaces being C-shaped surfaces and located along the clamping hole, multiple protrusions extending from an inside of the clamping hole and located about an axis of the clamping hole, a first outer periphery of the top surface being tangent to an inside of a first circle, a second outer periphery of the bottom surface located on a second circle, a diameter of the first circle being larger than a diameter of the second circle, the diameter of the second circle being larger than a diameter of the clamping hole, when the first and second circles are projected on the horizontal plane, the second circle is located within the first circle and is tangent to the second first circle at a tangent point which is located close to a front end of the first driving head, a shortest distance being defined between two respective centers of the first and second circles, the clamping hole and the first circle located on a common axis which is located on a vertical plane, the two respective centers of the first and second circles and the tangent point located on the vertical plane, the two jaws being symmetric relative to the vertical plane.

2. The wrench as claimed in claim 1, wherein the a middle point of a middle section of the top surface is located close to the handle, two respective outer peripheries of end sections of the top surface respectively extend along at least one first non-circular curve, the first non-circular curve is located farther than the first circle relative to the vertical plane.

3. The wrench as claimed in claim 2, wherein the first non-circular curve is an oval curve.

4. The wrench as claimed in claim 1, wherein a middle point of a middle section of the top surface is located close to the handle, two respective outer peripheries of middle section of the top surface respectively extend along at least one second non-circular curve, a distance from the middle point to a center of the first circle is larger than a radius of the first circle.

5. The wrench as claimed in claim 4, wherein the first non-circular curve is an oval curve.

6. The wrench as claimed in claim 1, wherein a second driving head is connected to a second end of the handle and the second driving head includes an opening.

7. The wrench as claimed in claim 1, wherein two respective first driving heads are connected to two ends of the handle and the two first driving heads face two opposite directions.

8. The wrench as claimed in claim 1, wherein the handle and the first driving head are flat relative to the horizontal plane.

9. The wrench as claimed in claim 1, wherein a top surface of the handle is parallel to the top surface.

10. The wrench as claimed in claim 1, wherein a 30-degree angle is defined between the adjacent protrusions.

11. The wrench as claimed in claim 1, wherein a 60-degree angle is defined between the adjacent protrusions.

* * * * *